US009737824B2

(12) United States Patent
Ejima

(10) Patent No.: US 9,737,824 B2
(45) Date of Patent: Aug. 22, 2017

(54) INPUT DEVICE

(71) Applicant: TOMY COMPANY, LTD., Tokyo (JP)

(72) Inventor: Takio Ejima, Chiba (JP)

(73) Assignee: TOMY COMPANY, LTD., Tokyo (JP)

( * ) Notice: Subject to any disclaimer, the term of this patent is extended or adjusted under 35 U.S.C. 154(b) by 147 days.

(21) Appl. No.: 14/945,553

(22) Filed: Nov. 19, 2015

(65) Prior Publication Data

US 2017/0036129 A1 Feb. 9, 2017

(30) Foreign Application Priority Data

Aug. 7, 2015 (JP) ..... 2015-156936

(51) Int. Cl.

| | |
|---|---|
| ***A63H 3/16*** | (2006.01) |
| ***A63H 33/00*** | (2006.01) |
| ***A63H 3/00*** | (2006.01) |
| ***A63H 17/26*** | (2006.01) |
| *A63H 3/28* | (2006.01) |

(52) U.S. Cl.

CPC ..... *A63H 33/003* (2013.01); *A63H 3/003* (2013.01); *A63H 17/26* (2013.01); *A63H 3/28* (2013.01)

(58) Field of Classification Search

None

See application file for complete search history.

(56) References Cited

U.S. PATENT DOCUMENTS 3,257,517 A * 6/1966 Sedley ..... E05B 49/004 200/43.08
3,754,351 A * 8/1973 Glass ..... A63H 13/04 446/338
4,613,315 A * 9/1986 Kataoka ..... A63H 3/52 446/276
4,654,659 A * 3/1987 Kubo ..... A63H 13/00 340/13.29
5,670,761 A * 9/1997 Ryan ..... H01H 13/64 200/16 B (Continued)

FOREIGN PATENT DOCUMENTS

JP 4872019 6/2012

OTHER PUBLICATIONS

J-PlatPat Abstract, Publication No. 2012-115510, Published Jun. 21, 2012, corresponding to JP Patent No. 4872019.

*Primary Examiner* — Aarti B Berdichevsky
*Assistant Examiner* — Urszula M Cegielnik
(74) *Attorney, Agent, or Firm* — Staas & Halsey LLP

(57) ABSTRACT

An input device includes actuating pieces and keys. The actuating pieces are disposed inside a case and have portions disposed along a first direction at predetermined intervals. The portions are movable toward and away from each other and are urged closer to each other by a predetermined urging force. The keys are insertable in the first direction into a key hole in the case. The actuating pieces respectively include pressure receivers which are disposed without overlap in the first direction. Each key includes a pusher which selectively pushes the pressure receiver of at least one of the actuating pieces as a result of insertion of the key into the key hole and moves the actuating piece corresponding to the pushed pressure receiver in a direction against the predetermined urging force.

9 Claims, 4 Drawing Sheets

(56) References Cited

U.S. PATENT DOCUMENTS 6,159,101 A * 12/2000 Simpson ..... A63H 3/46 463/1
6,257,948 B1 * 7/2001 Silva ..... A63H 3/46 446/100
6,435,936 B1 * 8/2002 Rehkemper ..... A63H 3/28 446/297
6,547,631 B1 * 4/2003 Randall ..... A63H 3/28 446/175
6,565,411 B1 * 5/2003 Fosbenner ..... A63H 29/24 446/464
6,861,602 B2 * 3/2005 Juga ..... H01H 13/06 200/296
6,949,002 B2 * 9/2005 Yamaguchi ..... A63H 30/04 340/12.25
7,033,243 B2 * 4/2006 Hornsby ..... A63H 3/48 446/175
7,126,066 B1 * 10/2006 Corcino ..... H01H 9/285 200/318.2
7,131,887 B2 * 11/2006 Hornsby ..... A63H 3/48 446/175
7,207,860 B2 * 4/2007 Hornsby ..... A63H 33/00 446/353
8,366,509 B2 * 2/2013 Missler ..... A63H 18/12 246/4
2002/0123297 A1 * 9/2002 Hornsby ..... A63F 1/04 446/484
2005/0112993 A1 * 5/2005 Cheng ..... A63H 3/46 446/376
2005/0120515 A1 * 6/2005 Kato ..... G06F 1/1616 16/221
2006/0228982 A1 * 10/2006 Rehkemper ..... A63H 3/28 446/279
2006/0292965 A1 * 12/2006 Strauss ..... A63H 3/20 446/376
2007/0060011 A1 * 3/2007 Daftari ..... A63H 33/26 446/97
2010/0216367 A1 * 8/2010 Kasahara ..... A63H 3/16 446/97
2011/0130070 A1 * 6/2011 Hong ..... A63H 3/20 446/330
2012/0142248 A1 * 6/2012 Murayama ..... A63H 33/26 446/297
2014/0329435 A1 * 11/2014 Chan ..... A63H 3/36 446/376
2015/0144466 A1 * 5/2015 Schroll ..... H01H 9/285 200/43.13

* cited by examiner

INPUT DEVICE

BACKGROUND OF THE INVENTION

1. Field of the Invention

The present invention relates to an input device.

2. Description of Related Art

Operable toys have been known that include a switching mechanism as an input device. Such operable toys can be operated, for example, by inserting keys into the toys so as to operate switches in the toys (for example, refer to Japanese Patent No. 4872019).

Such a toy has the following switching mechanism: a key inserted into the toy is turned to activate several switches disposed in the turning range of the key.

SUMMARY OF THE INVENTION

The switching mechanism according to Japanese Patent No. 4872019 requires two key operation steps for activation of a switch: a first step of inserting a key into the toy and a second step of turning the inserted key.

An object of the present invention is to provide an input device that carries out a predetermined operation in response to mere insertion of a predetermined key into a case.

In order to realize the above object, according to one aspect of the present invention, there is provided an input device including:

actuating pieces which are disposed inside a case and have portions disposed along a first direction at predetermined intervals, the portions being movable toward and away from each other and being urged closer to each other by a predetermined urging force; and at least one key which is insertable in the first direction into a key hole in the case, wherein the actuating pieces respectively include pressure receivers which are disposed without overlap in the first direction, and wherein each key includes a pusher which selectively pushes the pressure receiver of at least one of the actuating pieces as a result of insertion of the key into the key hole and moves the actuating piece corresponding to the pushed pressure receiver in a direction against the predetermined urging force.

According to this configuration, mere insertion of the key into the case in the input device starts the operation of a corresponding actuating piece. Thus, an apparatus including the input device can carry out a predetermined operation.

Preferably, the at least one key comprises different types of keys which operate different actuating pieces or a combination of actuating pieces.

According to this configuration, use of several different keys can start operations in various modes of an apparatus including the input device.

Preferably, each of the actuating pieces comprises a hole, and the pressure receiver is a circumferential area of the hole.

More preferably, the holes in the actuating pieces have similar shapes.

According to this configuration, the pressure receiver is composed of the circumferential area of the hole. Thus, the pressure receiver can be readily provided on the actuating piece. The large circumferential area around the hole can be pushed to certainly move the actuating piece.

Preferably, the circumferences of the holes of the actuating pieces are visible in the first direction from the key hole, and the at least one key has cross-sectional diameters which decrease stepwise toward the tip.

According to this configuration, the key has stepwise cross-sections. Thus, the formation of the key is facilitated.

Preferably, the actuating pieces are turnable about a support shaft.

According to this configuration, the actuating pieces are provided on the single support shaft. Thus, the dimensions of the input device can be decreased.

Preferably, each of the actuating pieces comprises an oblong hole having a major axis orthogonal to the support shaft, and the pressure receiver is a circumferential area of the hole.

According to this configuration, oblong holes are formed. Thus, the actuating pieces can certainly turn.

Preferably, the input device further includes a switch which is turned on and off in response to movement of one of the actuating pieces.

According to this configuration, mere insertion of the key into the case starts the operation of the corresponding actuating piece, thereby activating a predetermined switch.

Preferably, the case is an outer shell of a figurative toy, and the switch controls the operation of the figurative toy.

According to this configuration, mere insertion of the key into the case can cause the figurative toy to carry out a predetermined operation.

BRIEF DESCRIPTION OF THE DRAWINGS

The present invention will become more fully understood from the detailed description given hereinbelow and the appended drawings which are given byway of illustration only, and thus are not intended as a definition of the limits of the present invention, and wherein.

DETAILED DESCRIPTION OF THE PREFERRED EMBODIMENT

Embodiments of an input device according to the present invention will now be described with reference to the accompanying drawings.

Overall Configuration

Figure 1:
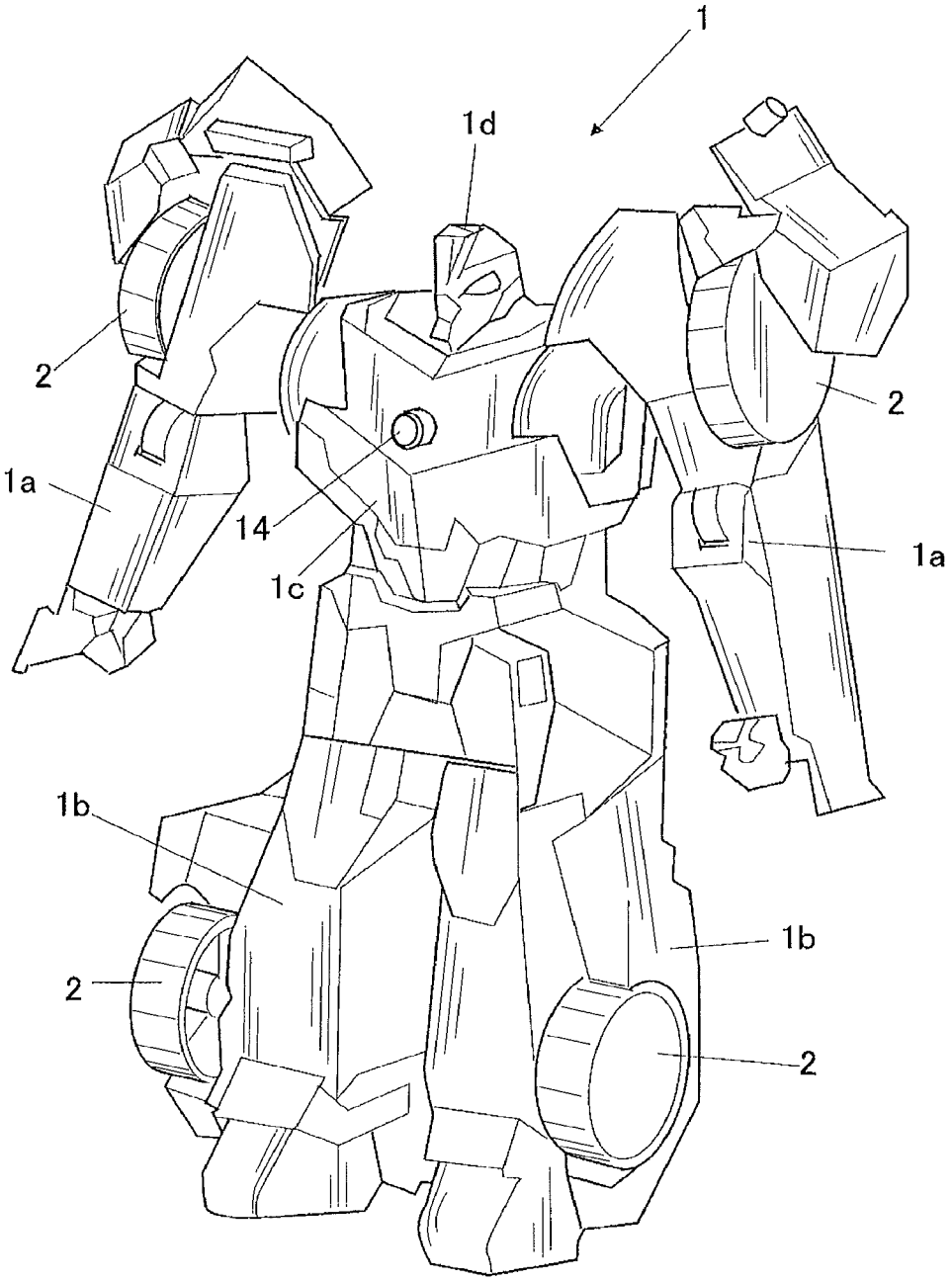
FIG. 1 is a perspective view illustrating a toy robot including an input device according to the present invention.

A toy robot 1 illustrated in FIG. 1 is transformed by expansion of a toy vehicle. The toy robot 1 includes wheels 2 on arms 1*a* and legs 1*b*. The wheels 2 function as decoration in a toy robot mode and function as traveling wheels in a vehicle mode.

Figure 2:
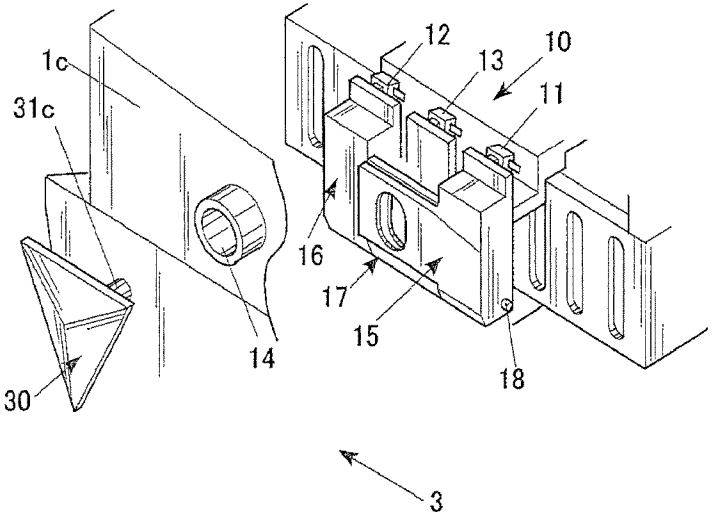
FIG. 2 is a perspective view illustrating the input device according to the present invention.

An input device 3 which is illustrated in FIG. 2 is installed inside the chest 1*c* of the toy robot 1. The input device 3 includes three switches 11, 12, 13. The switches 11, 12, 13 are selectively activated in response to insertion of a predetermined key 30 (see FIG. 2) into a key hole 14 in the front case of the chest 1*c* of the toy robot 1 so as to generate a predetermined sound.

Detailed Configuration

1. Switch Unit 10

As described above, the input device 3 includes a switch unit 10. The switch unit 10 includes the switches 11, 12, 13, which are disposed along the horizontal direction of the toy robot 1. The switches 11, 12, 13 respectively include pairs of terminals 11*b*, 12*b*, 13*b*, which are electrically connected in response to operation of respective actuators 11*a*, 12*a*, 13*a* (see FIG. 3).

2. Actuating Pieces 15, 16, 17

Figure 3:
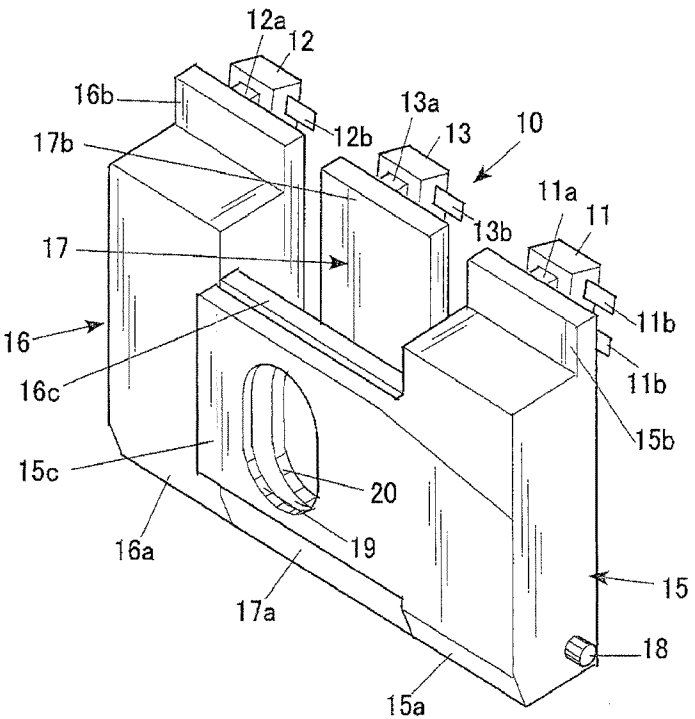
FIG. 3 is perspective view illustrating essential components of the input device illustrated in FIG. 2.

With reference to FIG. 3, actuating pieces 15, 16, 17 are provided at the front of the switch unit 10. The bases 15*a*, 16*a*, 17*a* of the respective actuating pieces 15, 16, 17 are disposed along the horizontal direction of the toy robot 1. The bases 15*a*, 16*a*, 17*a* are supported by a single shaft 18. The actuating pieces 15, 16, 17 turn about the shaft 18 and are urged forward by a torsion spring (not shown) disposed around the shaft 18. The upper areas of the actuating pieces 15, 16, 17 respectively constitute contact portions 15*b*, 16*b*, 17*b*. The contact portions 15*b*, 16*b*, 17*b* respectively correspond to the switches 11, 12, 13 and are disposed in front of the actuators 11*a*, 12*a*, 13*a* of the switches 11, 12, 13. The contact portions 15*b*, 16*b*, 17*b* respectively rotate around the shaft 18 toward the switches 11, 12, 13 and come into contact with the actuators 11*a*, 12*a*, 13*a*, thereby operating the actuators 11*a*, 12*a*, 13*a*.

A middle portion 15*c* of the actuating piece 15 is disposed in front of the actuating piece 17 and extends toward the actuating piece 16. A middle portion 16*c* of the actuating piece 16 is disposed behind the middle portion 15*c* of the actuating piece 15 and in front of the actuating piece 17 and extends toward the actuating piece 15. The middle portion 15*c* of the actuating piece 15, the middle portion 16*c* of the actuating piece 16, and the actuating piece 17 overlap with each other in the anteroposterior direction with predetermined gaps therebetween.

The middle portion 15*c* of the actuating piece 15 has a hole 19, and the middle portion 16*c* of the actuating piece 16 has a hole 20. The oblong holes 19, 20 have major axes orthogonal to the shaft 18. The holes 19, 20 are concentric with a key hole 14 when the actuating pieces 15, 16 are at initial positions. The hole 19 has a shape similar to that of the hole 20 but is larger than the hole 20. Thus, the circumferences of both holes are visible from the key hole 14. The circumferential area of the hole 19 in the actuating piece 15 and the circumferential area of the hole 20 in the actuating piece 16 constitute pressure receivers. The actuating piece 17 also has a pressure receiver. The pressure receivers of the actuating pieces 15, 16, 17 do not overlap with each other in the insertion direction of the key 30.

3. Key Hole 14

The chest 1*c* of the toy robot 1 has a key hole 14. The key hole 14 has a circular shape and a diameter larger than the minor axis of the hole 19.

4. Key 30

Figure 4:
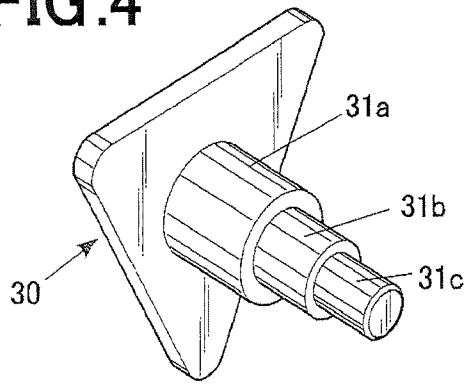
FIG. 4 is an enlarged perspective view illustrating a key.

With reference to FIGS. 5A to 5D and FIGS. 6A to 6C, the input device 3 is provided with seven types of keys 30*a* to 30*g* (which are collectively referred to as key 30, unless they should be differentiated). FIG. 4 illustrates an example key 30. The rear end of the key 30 has a decorative knob that decorates the chest 1*c* of the toy robot 1 when the key 30 is disposed in the key hole 14. The decorative knob may have different designs depending on the type of the key 30. The key 30 may be provided on any other toy robot that can be combined with the toy robot 1.

The keys 30*a* to 30*g* may each consist of a guiding shaft 31*a* alone, or any combination of a guiding shaft 31*a* with a shaft 31*b* and/or a shaft 31*c*. If the guiding shaft 31*a* is combined with the shaft 31*b* and/or the shaft 31*c*, the cross-sectional diameters of the shafts decrease stepwise toward the tip. The guiding shaft 31*a* is a long or short shaft having a large diameter. The shaft 31*b* is a long or short shaft having a medium diameter. The shaft 31*c* is a long, medium-length, or short shaft having a small diameter.

The terms "large diameter," "medium diameter," and "small diameter" refer to the relative diameters of the guiding shaft 31*a* and the shafts 31*b*, 31*c*.

The guiding shaft 31*a* has a diameter slightly smaller than that of the key hole 14 in the chest 1*c* of the toy robot 1 and larger than the minor axis of the hole 19.

The shaft 31*b* has a diameter slightly smaller than the minor axis of the hole 19 and larger than the minor axis of the hole 20.

The shaft 31*c* has a diameter slightly smaller than the minor axis of the hole 20.

Figure 5A:
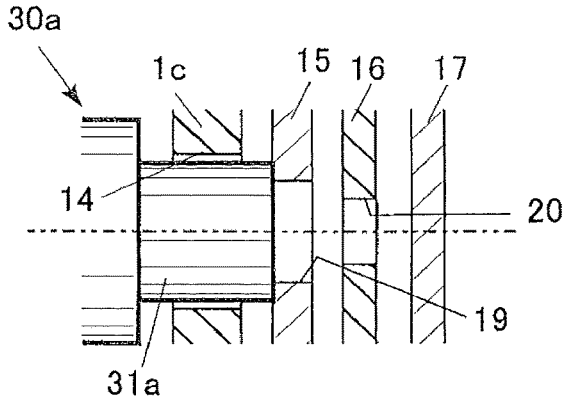
FIGS. 5A to 5D are schematic views illustrating different operating modes of the input device.

(1) Key 30*a* (FIG. 5A)

The key 30*a* is composed of a long guiding shaft 31*a*. In detail, the guiding shaft 31*a* has dimensions that allow a pusher at the end of guiding shaft 31*a* to push only the pressure receiver of the actuating piece 15 when the key 30*a* is disposed in the key hole 14.

Figure 5B:
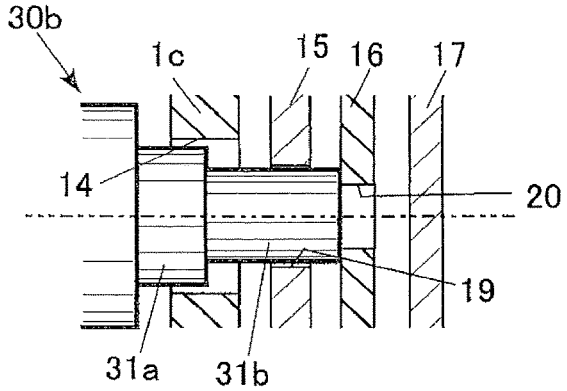

(2) Key 30*b* (FIG. 5B)

The key 30*b* is composed of a short guiding shaft 31*a* and a long shaft 31*b* disposed on the end surface of the guiding shaft 31*a*. In detail, the guiding shaft 31*a* has dimensions that prevent a pusher at the end of the guiding shaft 31*a* from pushing the pressure receiver of the actuating piece 15 when the key 30*b* is disposed in the key hole 14. Furthermore, the shaft 31*b* has dimensions that allow a pusher at the end of the shaft 31*b* to push only the pressure receiver of the actuating piece 16 when the key 30*b* is disposed in the key hole 14.

Figure 5C:
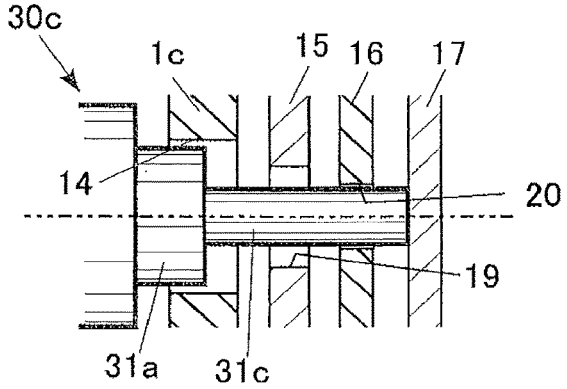

(3) Key 30*c* (FIG. 5C)

The key 30*c* is composed of a short guiding shaft 31*a* and a long shaft 31*c* disposed on the end surface of the guiding shaft 31*a*. In detail, the guiding shaft 31*a* has dimensions that prevent a pusher at the end of the guiding shaft 31*a* from pushing the pressure receiver of the actuating piece 15 when the key 30*c* is disposed in the key hole 14. Furthermore, the shaft 31*c* has dimensions that allow a pusher at the end of the shaft 31*c* to push only the pressure receiver of the actuating piece 17 when the key 30*a* is disposed in the key hole 14.

Figure 5D:
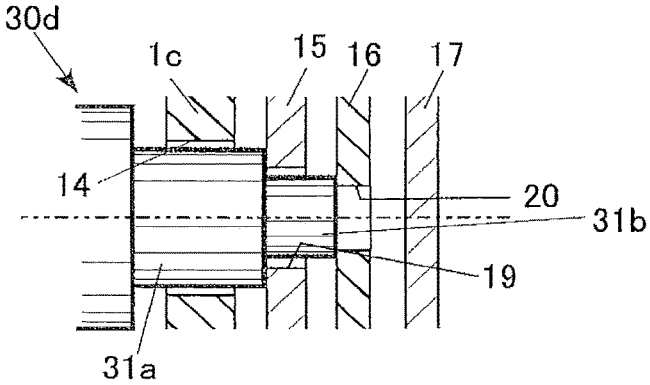

(4) Key 30*d* (FIG. 5D)

The key 30*d* is composed of a long guiding shaft 31*a* and a short shaft 31*b* disposed on the end surface of the guiding shaft 31*a*. In detail, the guiding shaft 31*a* has dimensions that allow a pusher at the end of the guiding shaft 31*a* to push only the pressure receiver of the actuating piece 15 when the key 30*d* is disposed in the key hole 14. Furthermore, the shaft 31*b* has dimensions that allow a pusher at the end of the shaft 31*b* to push only the pressure receiver of the actuating piece 16 when the key 30*d* is disposed in the key hole 14.

Figure 6A:
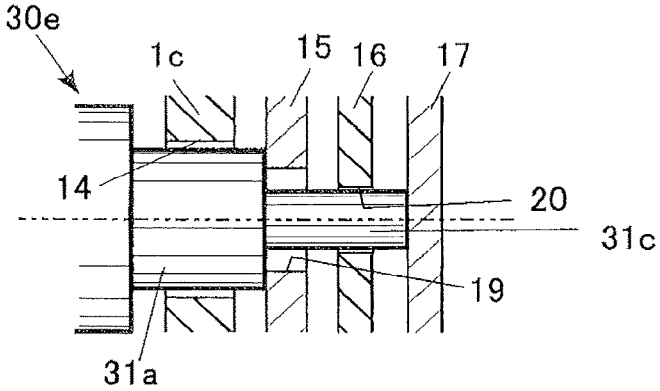
FIGS. 6A to 6C are schematic views illustrating different operating modes of the input device.

(5) Key 30*e* (FIG. 6A)

The key 30*e* is composed of a long guiding shaft 31*a* and a medium-length shaft 31*c* disposed on the end surface of the guiding shaft 31*a*. In detail, the guiding shaft 31*a* has dimensions that allow a pusher at the end of the guiding shaft 31*a* to push only the pressure receiver of the actuating piece 15 when the key 30*e* is disposed in the key hole 14. Furthermore, the shaft 31*c* has dimensions that allow a pusher at the end of the shaft 31*c* to push only the pressure receiver of the actuating piece 17 when the key 30*e* is disposed in the key hole 14.

Figure 6B:
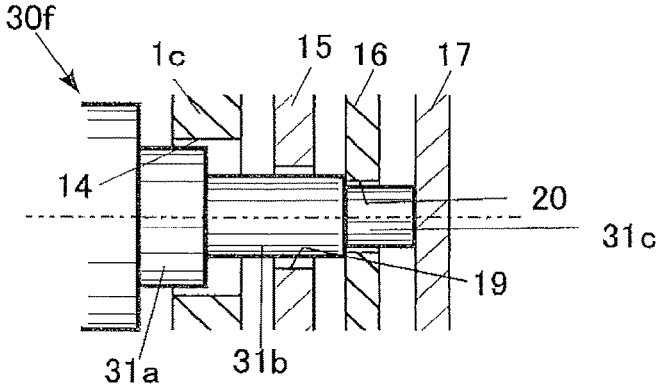

(6) Key 30*f* (FIG. 6B)

The key 30*f* is composed of a short guiding shaft 31*a*, a long shaft 31*b* disposed on the end surface of the guiding shaft 31*a*, and a short shaft 31*c* disposed on the end surface of the shaft 31*b*. In detail, the guiding shaft 31*a* has dimensions that prevent a pusher at the end of the guiding shaft 31*a* from pushing the pressure receiver of the actuating piece 15 when the key 30*f* is disposed in the key hole 14. The shaft 31*b* has dimensions that allow a pusher at the end of the shaft 31*b* to push the pressure receiver of the actuating piece 16 when the key 30*f* is disposed in the key hole 14. The shaft 31*c* also has dimensions that allow a pusher at the end of the shaft 31*c* to push the pressure receiver of the actuating piece 17 when the key 30*f* is disposed in the key hole 14.

Figure 6C:
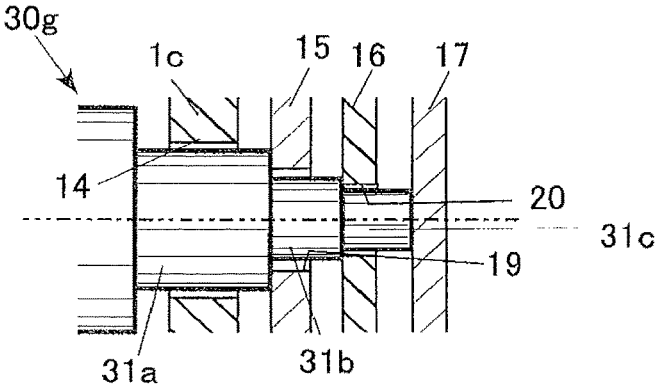

(7) Key 30*g* (FIG. 6C)

The key 30*g* is composed of a long guiding shaft 31*a*, a short shaft 31*b* disposed on the end surface of the guiding shaft 31*a*, and a short shaft 31*c* disposed on the end surface of the shaft 31*b*. In detail, the guiding shaft 31*a* has dimensions that allows a pusher at the end of the guiding shaft 31*a* to push only the pressure receiver of the actuating piece 15 when the key 30*g* is disposed in the key hole 14. The shaft 31*b* has dimensions that allow a pusher at the end of the shaft 31*b* to push the pressure receiver of the actuating piece 16 when the key 30*g* is disposed in the key hole 14. The shaft 31*c* has dimensions that allow a pusher at the end of the shaft 31*c* to push the pressure receiver of the actuating piece 17 when the key 30*g* is disposed in the key hole 14.

5. Operation of Input Device 3

(1) Use of Key 30*a*

Insertion of the key 30*a* into the key hole 14 in the toy robot 1 as illustrated in FIG. 5A causes the pusher at the end of the guiding shaft 31*a* to push the pressure receiver of the actuating piece 15, thereby turning the actuating piece 15 against the urging force of the torsion spring. This operates the actuator 11*a* of the switch 11. In this case, the other actuating pieces 16, 17 are not pushed and thus the switches 12, 13 are not activated.

(2) Use of Key 30*b*

Insertion of the key 30*b* into the key hole 14 in the toy robot 1 as illustrated in FIG. 5B causes the pusher at the end of the shaft 31*b* to pass through the hole 19 in the actuating piece 15 and push the pressure receiver of the actuating piece 16, thereby turning the actuating piece 16 against the urging force of the torsion spring. This operates the actuator 12*a* of the switch 12. In this case, the other actuating pieces 15, 17 are not pushed and thus the switches 11, 13 are not activated.

(3) Use of Key 30*c*

Insertion of the key 30*c* into the key hole 14 in the toy robot 1 as illustrated in FIG. 5C causes the pusher at the end of the shaft 31*c* to pass through the holes 19, 20 in the actuating pieces 15, 16 and push the pressure receiver of the actuating piece 17, thereby turning the actuating piece 17 against the urging force of the torsion spring. This operates the actuator 13*a* of the switch 13. In this case, the other actuating pieces 15, 16 are not pushed and thus the switches 11, 12 are not activated.

(4) Use of Key 30*d*

Insertion of the key 30*d* into the key hole 14 in the toy robot 1 as illustrated in FIG. 5D causes the pusher at the end of the guiding shaft 31*a* to push the pressure receiver of the actuating piece 15, and the pusher at the end of the shaft 31*b* to pass through the hole 19 and push the pressure receiver of the actuating piece 16, thereby turning the actuating pieces 15, 16 against the urging force of the torsion spring. This operates the actuators 11*a*, 12*a* of the switches 11, 12, respectively. In this case, the other actuating piece 17 is not pushed and thus the switch 13 is not activated.

(5) Use of Key 30*e*

Insertion of the key 30*e* into the key hole 14 in the toy robot 1 as illustrated in FIG. 6A causes the pusher at the end of the guiding shaft 31*a* to push the pressure receiver of the actuating piece 15, and the pusher at the end of the shaft 31*c* to pass through the holes 19, 20 and push the pressure receiver of the actuating piece 17, thereby turning the actuating pieces 15, 17 against the urging force of the torsion spring. This operates the actuators 11*a*, 13*a* of the switches 11, 13, respectively. In this case, the other actuating piece 16 is not pushed and thus the switch 12 is not activated.

(6) Use of Key 30*f*

Insertion of the key 30*f* into the key hole 14 in the toy robot 1 as illustrated in FIG. 6B causes the pusher at the end of the shaft 31*b* to pass through the hole 19 in the actuating piece 15 and push the pressure receiver of the actuating piece 16, and the pusher at the end of the shaft 31*c* to pass through the holes 19, 20 and push the pressure receiver of the actuating piece 17, thereby turning the actuating pieces 16, 17 against the urging force of the torsion spring. This operates the actuators 12*a*, 13*a* of the switches 12, 13, respectively. In this case, the other actuating piece 15 is not pushed and thus the switch 11 is not activated.

(7) Use of Key 30*g*

Insertion of the key 30*g* into the key hole 14 in the toy robot 1 as illustrated in FIG. 6C causes the pusher at the end of the guiding shaft 31*a* to push the pressure receiver of the actuating piece 15, the pusher at the end of the shaft 31*b* to pass through the hole 19 in the actuating piece 15 and push the pressure receiver of the actuating piece 16, and the pusher at the end of the shaft 31*c* to pass through the holes 19, 20 and push the pressure receiver of the actuating piece 17, thereby turning the actuating pieces 15, 16, 17 against the urging force of the torsion spring. This operates the actuators 11*a*, 12*a*, 13*a* of the switches 11, 12, 13, respectively.

In the toy robot 1 including such an input device 3, for example, ON signals are sent from the switches 11, 12, 13 to a controller circuit so as to output audio signals corresponding to the modes indicated by the ON signals.

The embodiments described above should not be construed to limit the present invention and may have any modification within the scope of the invention.

In the embodiment described above, the three switches 11, 12, 13 are turned on. Alternatively, for example, normally closed switches may be turned off. Alternatively, two switches or four or more switches may be provided.

In the embodiment described above, the three switches 11, 12, 13 are turned on. Alternatively, the actuating pieces 16, may be operated to temporarily activate operational components other than switches.

In the embodiment described above, the holes 19, 20 in the actuating pieces have ecliptic shapes so as to prevent interference with the shafts 31*a*, 31*b*, 31*c* during turn of the actuating pieces 15, 16, 17. Alternatively, the holes may have circular shapes if the actuating pieces 15, 16, 17 are slidable in a direction parallel to the centers of the shafts.

In the embodiment described above, the circumferential areas of the holes 19, 20 constitute pressure receivers. Alternatively, the edges of the end surfaces of the actuating pieces or the edges of notches in the actuating pieces may serve as the pressure receivers.

The input device 3 according to the present invention can be installed in toys other than toy robots, such as vehicle toys. The input device 3 may have control modes other than those involving audio and light indicators: for example, control modes involving several different preprogramed motions. Furthermore, the input device 3 may be used for authentication of the operator.

In an embodiment described above, multiple keys having different pushers are used. Alternatively, different pushers maybe disposed around the circumference of a single key so that different actuating pieces can be operated depending on the insertion angle of the key.

This U.S. patent application claims priority to Japanese patent application No. 2015-156936 filed on Aug. 7, 2015, the entire contents of which are incorporated by reference herein for correction of incorrect translation.

What is claimed is:

1. An input device comprising:

actuating pieces which are disposed inside a case and have portions disposed along a first direction at predetermined intervals, the portions being movable toward and away from each other and being urged closer to each other by a predetermined urging force; and at least one key which is insertable in the first direction into a key hole in the case, wherein the actuating pieces respectively include pressure receivers which are disposed without overlap in the first direction, and wherein each key includes a pusher which selectively pushes the pressure receiver of at least one of the actuating pieces as a result of insertion of the key into the key hole and moves the actuating piece corresponding to the pushed pressure receiver in a direction against the predetermined urging force.

2. The input device according to claim 1, wherein the at least one key comprises different types of keys which operate different actuating pieces or a combination of actuating pieces.

3. The input device according to claim 1, wherein each of the actuating pieces comprises a hole, and wherein the pressure receiver is a circumferential area of the hole.

4. The input device according to claim 3, wherein the holes in the actuating pieces have similar shapes.

5. The input device according to claim 4, wherein the circumferences of the holes of the actuating pieces are visible in the first direction from the key hole, and wherein the at least one key has cross-sectional diameters which decrease stepwise toward the tip.

6. The input device according to claim 1, wherein the actuating pieces are turnable about a support shaft.

7. The input device according to claim 6, wherein each of the actuating pieces comprises an oblong hole having a major axis orthogonal to the support shaft, and wherein the pressure receiver is a circumferential area of the hole.

8. The input device according to claim 1 further comprising:

a switch which is turned on and off in response to movement of one of the actuating pieces.

9. The input device according to claim 8, wherein the case is an outer shell of a figurative toy, and the switch controls the operation of the figurative toy.

* * * * *